US005595173A

United States Patent [19]

Dodd, Jr.

[11] Patent Number: 5,595,173

[45] Date of Patent: Jan. 21, 1997

[54] REHUMIDIFICATION FILTER FOR VENTILATION MASK

[76] Inventor: Nevin W. Dodd, Jr., 122 Oaks Dr., Columbus, Miss. 39701

[21] Appl. No.: 496,672

[22] Filed: Jun. 29, 1995

[51] Int. Cl.[6] ..... A62B 7/14

[52] U.S. Cl. ..... 128/201.13; 128/203.12; 128/204.13; 128/205.25; 128/205.27; 128/206.17

[58] Field of Search ..... 128/201.13, 203.26, 128/204.17, 205.25, 205.27, 206.17, 206.24, DIG. 35, 203.12, 203.29, 204.13, 204.16

[56] References Cited

U.S. PATENT DOCUMENTS

| | | | |
|---|---|---|---|
| 603,021 | 4/1898 | Dight | 128/201.13 |
| 1,488,970 | 3/1922 | Bell | 128/206.17 |
| 2,104,016 | 10/1935 | Biggs | 128/206.24 |
| 2,468,383 | 2/1948 | Tiffany | 128/201.13 |
| 2,744,524 | 5/1956 | Whipple | 128/206.17 |
| 3,099,987 | 8/1963 | Bartlett, Jr. | 128/204.13 |
| 3,102,537 | 10/1963 | Bartlett, Jr. | 128/204.13 |
| 3,161,491 | 3/1961 | Gongoll et al. | 128/206.17 |
| 3,326,214 | 6/1967 | McCoy | 128/201.13 |
| 4,136,691 | 1/1979 | Ebeling et al. | 128/201.13 |
| 4,141,703 | 2/1979 | Mulehi | 128/206.15 |
| 4,197,841 | 4/1980 | Brauer et al. | 128/201.13 |
| 4,705,033 | 11/1987 | Halfpenny | 128/204.13 |
| 4,832,018 | 5/1989 | Pantaleon-Stemberg | 128/206.17 |
| 4,941,467 | 7/1990 | Takata | 128/204.13 |
| 4,945,907 | 8/1990 | Tayebi | 128/206.17 |
| 5,022,394 | 6/1991 | Chmielinski | 128/206.17 |
| 5,140,980 | 8/1992 | Haughey et al. | 128/206.17 |
| 5,240,479 | 8/1993 | Bachinski | 128/206.17 |
| 5,386,825 | 2/1995 | Bates | 128/205.25 |
| 5,429,683 | 7/1995 | Le Mitouarel | 128/205.25 |

*Primary Examiner*—V. Millin
*Assistant Examiner*—V. Srivastava
*Attorney, Agent, or Firm*—Richard C. Litman

[57] ABSTRACT

A compact, light-weight, disposable, and quick-fit rehumidification filter device adapted to fit flight-masks which deliver pressurized respiratory fluids to a human. The preferred embodiment is made up of a container, a continuous strip of micropore filter paper helically rolled so as to entirely fill the space defined by the cross section of the container, optional directionally louvered screens affixed to the container, and a securing mechanism which detachably secures the filter device to the flight-mask. The securing mechanism is adapted to mate with a retaining ring projection common to most flight-masks by use of a matingly threaded ring or by a structure which flexibly and resiliently clips onto the outer circumferential surface of the retaining ring projection. The filter paper acts as a humidification counter-exchange apparatus by first extracting moisture from exhaled breath, then subsequently returning moisture to dehumidified respiratory fluids being inhaled. The filter paper has a wicking effect that helps evenly distribute the moisture. A second embodiment of the invention is made up of filter paper generally molded to the contours of the face-mask and made from filter paper combining suitable rigidity and respiratory fluid flow properties. The filter surface may be exposed to contact with the face to maximize the absorption of transpired skin moisture. The filter paper may be used in a multilayered structure to achieve sufficient rigidity or a plasticized layer may be adhered to the external surface of the paper.

4 Claims, 3 Drawing Sheets

REHUMIDIFICATION FILTER FOR VENTILATION MASK

BACKGROUND OF THE INVENTION

1. Field of the Invention

The present invention relates to a rehumidification filter for masks used for ventilation of dehumidified fluids.

2. Description of the Prior Art

Modifying the air that a human breathes has been a concern since the recognition that the human condition can be affected by modifying such air. Therefore, respiratory devices used to modify the air breathed under various circumstances, involving for example high-altitude flight and medical conditions, are abundant in the prior art.

Nevertheless, the devices heretofore proposed have not met with commercial success for a variety of reasons, including for example, extreme bulkiness, heavy weight, many moving parts, expensive non-disposable filters and tortuous passageways which cause extra expenditure of energy on the part of the human during both inhalation and exhalation.

For example, U.S. Pat. No. 3,099,987 issued Aug. 6, 1963 to Bartlett, Jr describes a respiratory apparatus intended primarily for use in military high-altitude applications, i.e. a flight-mask which sealing covers the mouth and nose of a user having a source of pressurized respirant which entry into the mask is controlled by valve structures. The apparatus includes a filter device containing a granular moisture transfer means, usually silica gel, whose container is wholly incorporated into the pathway of the inspired and expired fluids. The container is adapted at one end to be inserted into the mask, and on the other end detachably secured onto the valve structures. The container is further described to require screens secured to each end of the container for suitably confining the moisture exchange material therein. A valve foundation plate serves as the main connection structure between the mask and container structure and the valve structures. This plate has two large holes which serve to channel the expired and inspired fluids through their respective valves. This structure fails to provide a simple and inexpensive means of providing humidified respirant to the user.

U.S. Pat. No. 3,102,537 issued Mar. 7, 1963 to Bartlett, Jr also describes a flight-mask which is a combination valve-less mask and a box-like structure containing valve and rehumidifying devices. Moisture transfer membranes, such as paper toweling having suitable capillary pores running throughout the thickness of the membranes, are interposed within the inspiratory and expiratory channels of the box-like structure. Again, this structure fails to provide a simple and inexpensive means of providing humidified respirant to the user.

U.S. Pat. No. 4,941,467 issued Jul. 17, 1990 to Takata describes a relatively simple humidification face-mask, similar in appearance to a surgical mask, intended for use in dry air environments such as airliner passengers must endure. The mask combines an inner mask member and an outer mask member between which a moisturizing pad is held. The moisturizing pad is adapted to carry a volume of water to humidify the air. A similar application is suggested in U.S. Pat. No. 4,705,033 issued Nov. 10, 1987 to Halfpenny, which describes a conical humidification face-mask containing a open-celled foam member also adapted to hold water across which inhaled air passes. However, the filtering structures are integral to the mask.

U.S. Pat. No. 2,468,383 issued Apr. 26, 1949 to Tiffany describes a nasal and sinus protector and warmer which is designed in appearance to resemble eyeglass frames wherein the nasal mask connects with tubing running contiguously with the brow of the face and which tubing terminates behind each ear. The terminus of the tubing contains an undefined filter. U.S. Pat. No. 5,386,825 issued Feb. 7, 1995 to Bates describes a respiratory breathing filter which is removably contained in an orally inserted apparatus through which the user breathes. Each of these filters are uniquely adapted for use with its device.

Several patents describe the use of metal netting, mesh or wire-gauze type structures for the purpose of heat and moisture exchange which operate on the principal of a counter-flow exchange in cold air conditions, whereby a loose or open structure of the metal mesh allows an almost entirely free passage of air yet recovers some heat and condensing humidity. U.S. Pat. No. 603,021 issued Apr. 26, 1898 to Dight describes a thermal inspirator which prevents the escape or ingress of air except through a tube which connects a heat storing chamber inclosed in the space under a hat and open to the air in such space with a nasal mask, through which the air is expelled and drawn in. The heat storing chamber is filled with a roll of metal wire-gauze. U.S. Pat. No. 3,326,214 issued Jun. 20, 1967 to McCoy describes a breath warming device using metal corrugated structures as heat exchange elements within a chamber. U.S. Pat. No. 4,136,691 issued Jan. 30, 1979 to Ebeling et al. describes a canister combined with a face-mask containing a heat exchanger made up of a continuous strip of wire netting wound helically to form a cylindrical netting roll. However, none of these devices teach the use of a disposable filter with a mask or describe a structure wherein air flow is substantially unrestricted while humidifying the air.

Therefore, despite the abundant variations of structure of devices which modify respiratory fluids, none of the above inventions and patents, taken either singly or in combination, is seen to describe the instant invention as claimed.

SUMMARY OF THE INVENTION

The present invention relates to a rehumidification filter for masks used for ventilation of dehumidified fluids.

The preferred embodiment of the present invention is a compact, light-weight, disposable, and easily attachable and removable rehumidification filter device adapted to fit masks which deliver pressurized respiratory fluids to a human. The preferred embodiment of the filter device is shown adapted to a pilot's flight-mask, the filter being made up of a generally cylindrical container comprising a first and second end, a continuous strip of micro-pore filter paper helically rolled so as to entirely fill the space defined by the cross section of the container, a directionally louvered screen affixed to the first and second ends, and a securing mechanism which detachably secures the filter device to a standard and commonly used flight-mask.

The aforementioned advantages of easy removability and attachment arise from the device's structural adaptation to a common component of many flight-masks. Commonly used flight-masks include a generally pyramido-conically shaped face-mask which sealingly seats over the nasal and oral facial areas of the pilot. The face-mask creates an internal space into which pressurized respiratory fluid is admitted by a complex valve apparatus of the flight-mask. The valve apparatus, located externally to the face-mask, is in communication with the internal space of the face-mask.

However, a common feature found within the internal space of the mask is a removable, threaded, annular retaining ring, which helps secure the face-mask to the valve apparatus and which when removed allows access to the valve apparatus from within the mask. This retaining ring usually circumscribes certain channel openings of entry and exit for the respiratory fluid, behind which openings the appropriate valve structures are found. The retaining ring is seated on a matingly threaded and annular projection permanently affixed to the valve apparatus.

Each aspect of structure of the present invention is designed to be as simple as possible while maintaining the purpose of the function and using materials throughout the device whereby the aforementioned advantages of quick-fit, disposability, compactness and light-weight are facilitated.

First, the securing mechanism may be adapted to mate with the retaining ring projection by use of a matingly threaded ring fixedly attached to the filter container or by a structure which flexibly and resiliently clips onto the outer circumferential surface of the retaining ring projection. Many plastics are currently available which may be used to meet these requirements.

Next, the core of the filter device contains a continuous strip of two-layer corrugated micro-pore filter paper, helically rolled. The primary function of the filter paper is to act as a humidification counter-exchange apparatus by first extracting moisture from exhaled breath, then subsequently returning moisture to dehumidified respiratory fluids being inhaled. The helical configuration provides a plurality of channels created by the corrugation of the paper, which serve to provide sufficient surface area for a counter-exchange of moisture as well as a direct, open and unimpeded channel to the valve openings. The roll is inserted into the container so that its cross-sectional area covers both the expiratory and inspiratory valve openings while maintaining a direct line of unrestricted respiratory fluid flow through the channels to the valve openings.

Finally, fixed directional louvers help circulate, direct and mix respiratory fluids over the entire cross section of the roll, whereby no one area of the roll becomes saturated with or depleted of moisture. The louvered screens may be affixed to the first and second ends at right angles to one another as a means of distributing respiratory fluid flow and may be manufactured from the same material as the securing mechanism.

Moreover, the filter paper has a wicking effect that helps distribute the moisture. Although the screens may be helpful, the presence of screens is not required to retain the roll in place within the container. Hence resistance to air flow may be further eliminated by the removal of the screens.

A second embodiment of the invention takes further advantage of the wicking properties of the filter paper. The second embodiment is a generally conical filter molded to the contours of the face-mask and made from filter paper combining suitable rigidity and respiratory fluid flow properties. Beginning as a reference point at the retaining ring projection, the conical filter is secured to the mask by an annular securing mechanism, similar to that found on the first embodiment, which clips onto the retaining ring projection. The filter paper then extends generally along the contour lines of the mask towards the face to a predetermined point within the internal space of the mask. This point may be chosen to allow the paper to come into contact with the face to maximize the absorption of transpired skin moisture.

The filter paper alone may be used in a multilayered structure to achieve sufficient rigidity. In addition or alternatively, a plasticized coating or layer may be adhered to the external surface of the paper so as to serve in function as the container described in the first embodiment.

To allow unimpeded respiratory fluid flow, the inner surface of the filter paper may contain enlarged pores for entry of the expired respiratory fluid into channels created by the corrugated paper. The channels run longitudinally and parallel with the contour lines of the face-mask away from the face toward exit apertures in the external surface of the filter device, the exit apertures being located within the circumference of the annular securing mechanism. The number and positioning of the enlarged pores are sufficient so as not to impede free flow of respiratory fluids along the corrugated channels.

Accordingly, it is a principal object of the invention to provide a device which humidifies a dehumidified respiratory fluid to be inhaled by a human through a face-mask by extracting moisture from exhaled respiratory fluid.

It is another object of the invention to provide a device which is adapted to quickly and easily attach to and be removed from commonly used masks.

It is a further object of the invention to provide a device that can rehumidify respiratory fluid which structure is simple and inexpensive to manufacture.

Still another object of the invention is to provide a device which is capable of being molded to a face-mask and absorb transpired skin moisture as a source of moisture for rebreathing.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a rehumidification filter for masks used for ventilation of dehumidified fluids.

Figure 1:
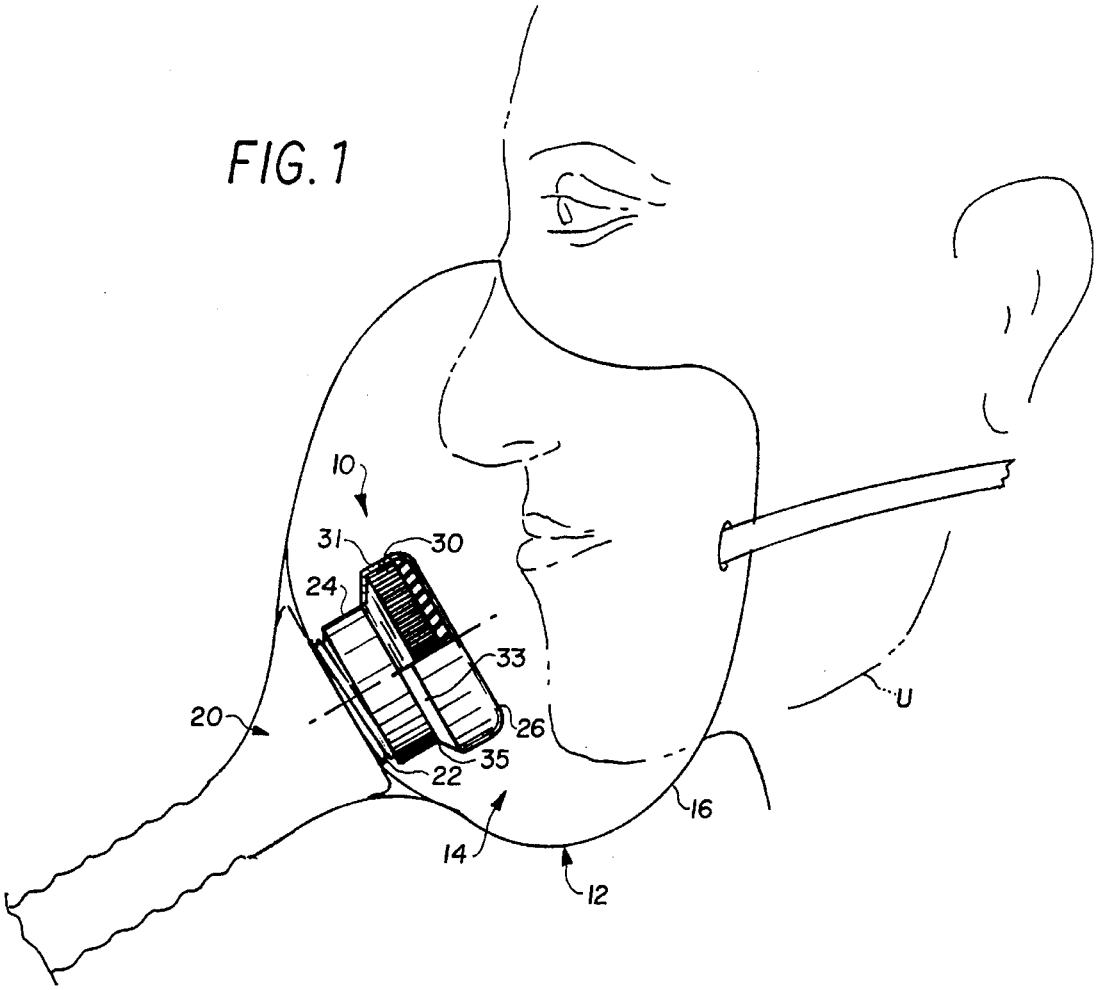
FIG. 1 is a side elevational view of the preferred embodiment of the rehumidification filter attached to a mask and valve apparatus in use, partially cut-away to show the filter and internal components of the filter.

Referring to FIG. 1, the rehumidification filter 10 is illustrated in use when attached to a pilot's flight-mask 12. An internal space 14 formed by a seal between a face-mask 16 and a user U is shown whereinto respiratory fluid passes during breathing. An external area 20, relative to the internal space 14, is shown in which valve component and other supply apparatus necessary to the operation of the flight-mask are housed. An annular projection 22 extends from the external area 20 by which a securing mechanism 24 secures the rehumidification filter 10 to the face-mask 16. A container 26, affixed to the securing mechanism 24, forms a cavity which houses a filter material 30.

Figure 2:
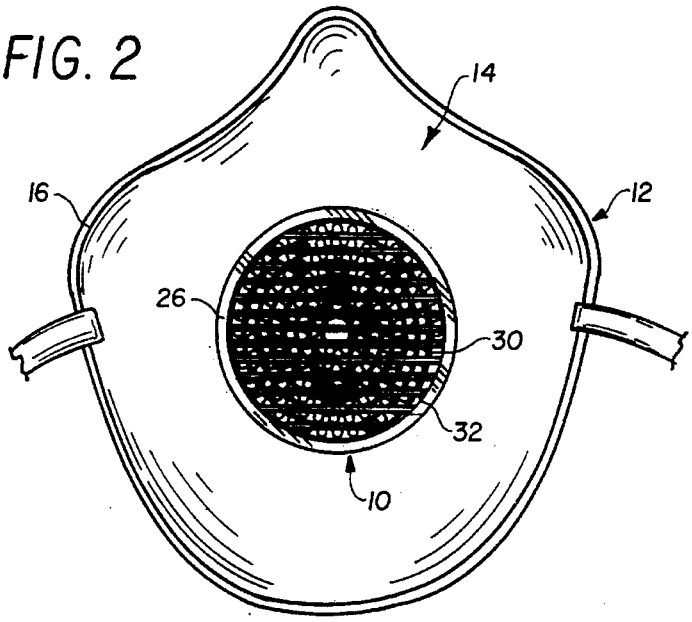
FIG. 2 is a front elevational view of the filter device and mask.
Figure 3:
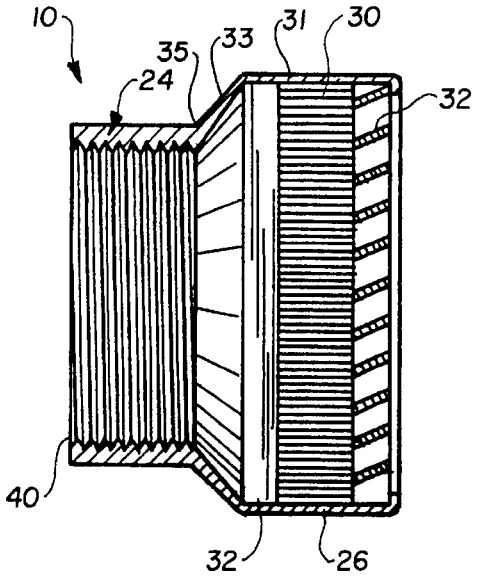
FIG. 3 is a medial cross-sectional view of the filter device.

Referring now to FIG. 2, peering into the internal space 14 of the flight-mask 12, the front of the rehumidification filter 10 can be seen. The filter is covered by a louvered screen 32 which assists circulation of air flow over the entirety of the filter material 30 housed within, as shown in FIG. 3. The container 26 is shown to have a cylindrical wall 31. Container 26 is enclosed at the proximate end solely by a screen 32. Disposed at the distal end of container 26 is an annular ridge 33. Annular ridge 33 extends inwardly from wall 31 and terminates at an edge 35 defining an opening into container 26. Securing mechanism 24 extends outwardly from edge 35. In both FIGS. 3 and 5, a louvered screen 32 is shown affixed to each the distal and the proximate end of the container 26 at right angles to one another as a means of circulating respiratory fluid flow over the filter material 30.

Figure 4:
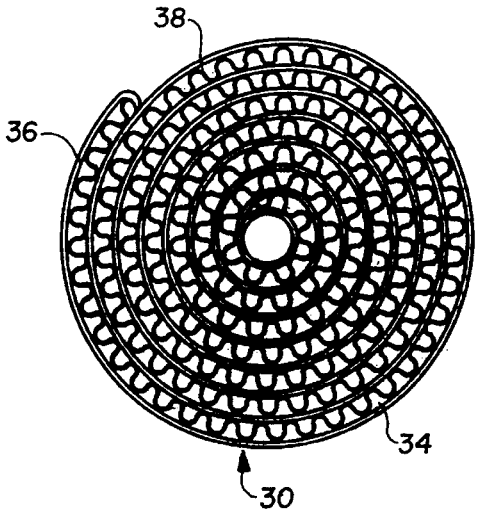
FIG. 4 is a cross sectional view of the filtering media with an enlarged view of its structure.

Referring now to FIG. 4, The filter material 30 within the container wall is a continuous strip of micro-pore filter paper. The paper is made of two layers, a first planar layer 36 and a second corrugated layer 38. The filter material 30 has been helically rolled to form a roll, which when viewed on end, creates a plurality of channels 34, formed to travel uninterrupted from a first end, proximate to the user, to a second end, distant to the user. Referring back to FIG. 2, the roll of filter material 30 is shown fixed and inserted within the container cavity with the proximate end nearest the viewer. At the distant end, expiratory and inspiratory valve openings (not shown) are found in the wall of the face-mask 16 which allow the transfer of respiratory fluid between the internal space 14 and the external area 20. This structure allows respiratory fluid flow to be directed through the channels 34 for counter-exchange of moisture with the filter material and yet maintain a direct, open and unimpeded respiratory fluid flow to the valve openings for exchange of expired respiratory fluid. Moreover, the filter material 30 may be retained in place within the container 26 by the use of an adhesive between the outermost layer of the helical roll and the cylindrical container wall 34, eliminating the need for a screen 32. Hence, resistance to air flow may be further reduced.

Figure 5:
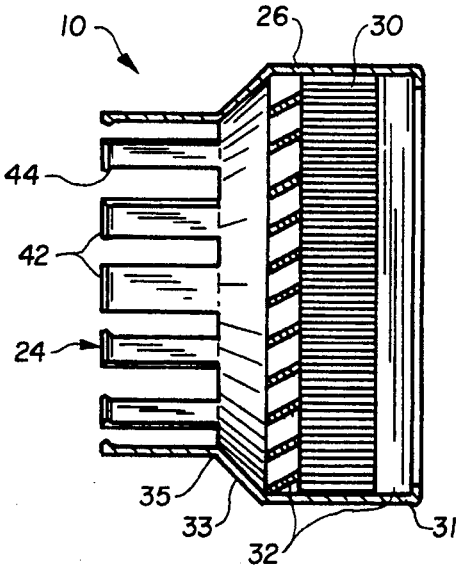
FIG. 5 is a medial cross-sectional view of a second embodiment of the filter device featuring an alternative securing mechanism.

Referring now to FIGS. 3 and 5, the rehumidification filter 10 is shown in two embodiments wherein the securing mechanism 24 varies. In FIG. 3 the securing mechanism 24 is adapted to mate with a threaded annular projection (22 as shown in FIG. 1), having a matingly threaded cylindrical wall 40 fixedly attached to the filter container 26. In FIG. 5, a second embodiment of the securing mechanism 24 is shown made up of a plurality of tabs 42 which flexibly and resiliently clip onto the outer circumferential surface of the threaded annular projection 22. Each tab 42 has a tooth 44 for engagement of a thread on the annular projection.

Figure 6:
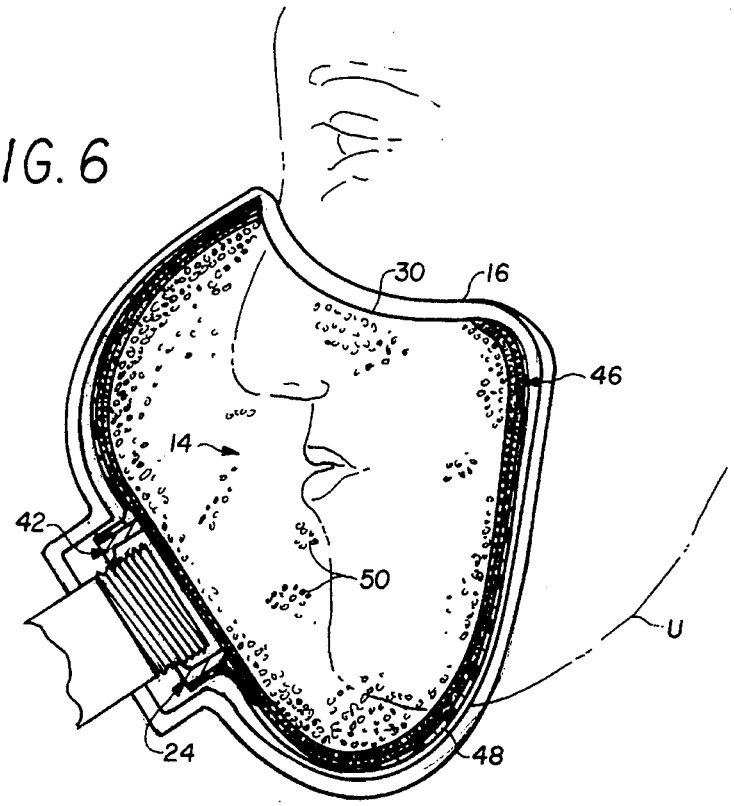
FIG. 6 is a medial cross-sectional view of a third embodiment of the filter device in use.

Referring now to FIG. 6, the filter material 30 is shaped generally conically and molded to the contours of the face-mask 16. The conical filter 46 is secured to the mask by a tabbed securing mechanism 24 as shown in FIG. 5. The filter material 30 then extends generally along the contour lines of the mask towards the face of the user U to a predetermined point within the internal space 14 of the face-mask. This point may be chosen to allow the paper to come into contact with the face to maximize the absorption of transpired skin moisture.

Figure 7:
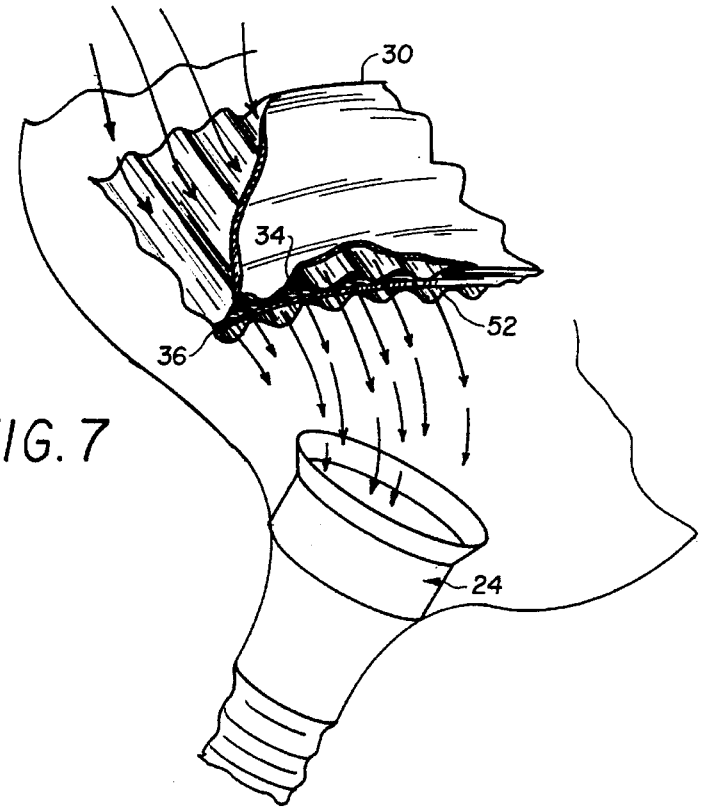
FIG. 7 is an enlarged view of the filtering media of the third embodiment shown if FIG. 6, showing the channels of passage of a respiratory fluid.

To achieve sufficient rigidity to avoid collapse of the shape of the conical filter 46, a plasticized coating or layer 48 may be adhered to the external surface of the filter material 30. In the alternative, multiple layers of the filter material 30 may be used to achieve sufficient rigidity of the conical filter 46 without the need of a plastic coating. In either alternative, in order to avoid impedance of respiratory fluid flow, the inner surface of the filter material 30 contains a plurality of enlarged pores 50 for entry of the expired respiratory fluid into the channels 34 created by the corrugation of the micro-pore filter paper. As can be best appreciated from FIG. 7, the channels 34 run longitudinally and parallel with the contour lines of the face-mask, starting from the pores 50. The channel then runs distally toward exit apertures 52 in the external surface of the first planar layer 36, the exit apertures 52 being located within the circumference of the annular securing mechanism 24. The pores are of sufficient number and positioning so as not to impede free flow of respiratory fluids along the corrugated channels yet provide adequate surface area over which moisture can be counter-exchanged.

It is to be understood that the present invention is not limited to the embodiments described above, but encompasses any and all embodiments within the scope of the following claims.

I claim:

1. A disposable rehumidification filter device for attachment to an annular projection within a flight ventilation mask, the device comprising:

a cylindrical container enclosed at one end by a screen and having an annular ridge at an opposite end thereof, said annular ridge terminating at an edge defining an opening, said container including an annular securing mechanism extending outwardly from said edge, an annular projection within the flight ventilation mask, said securing mechanism including attachment means for replaceably engaging said annular projection; and a coil of wicking sheet material filling said cylindrical container.

2. The disposable rehumidification filter device of claim 1 wherein said attachment means includes threads.

3. The disposable rehumidification filter device of claim 1 wherein said attachment means includes a plurality of resilient tabs.

4. A flight ventilation mask comprising:

a valve apparatus including an annular retaining ring;

a face mask defining an internal space into which said annular retaining ring extends; and a disposable rehumidification filter disposed within the internal space, said filter removably attached to said retaining ring, said filter including, a cylindrical container enclosed at one end by a screen and having an annular ridge at an opposite end thereof, said ridge terminating at an edge defining an opening, said container including an annular securing mechanism extending outwardly from said edge, said securing mechanism including attachment means for replaceably engaging said annular retaining ring, and a coil of wicking sheet material filling said cylindrical container.

* * * * *